United States Patent [19]

Oka et al.

[11] 4,345,014

[45] Aug. 17, 1982

[54] MAGNETIC BRUSH DEVELOPING METHOD FOR USE IN ELECTROGRAPHY EMPLOYING DUAL-COMPONENT DEVELOPING MATERIAL

[75] Inventors: Tateki Oka; Kenji Tabuchi; Susumu Tanaka, all of Sakai, Japan

[73] Assignee: Minolta Camera Kabushiki Kaisha, Osaka, Japan

[21] Appl. No.: 186,558

[22] Filed: Sep. 12, 1980

[30] Foreign Application Priority Data

Oct. 24, 1979 [JP] Japan ..... 54-138029

[51] Int. Cl.[3] ..... G03G 13/09

[52] U.S. Cl. ..... 430/122; 430/106.6

[58] Field of Search ..... 430/109, 110, 111, 107, 430/120, 122, 903, 39, 106.6

[56] References Cited

U.S. PATENT DOCUMENTS 3,900,588 8/1975 Fisher ..... 430/120

4,031,021 6/1977 Deming ..... 430/109

FOREIGN PATENT DOCUMENTS 54-66134 5/1979 Japan .

54-121129 9/1979 Japan .

*Primary Examiner*—Richard L. Schilling

*Assistant Examiner*—John L. Goodrow

*Attorney, Agent, or Firm*—Wenderoth, Lind & Ponack

[57] ABSTRACT

An improved magnetic brush developing method for use in electrography which employs a dual-component developing material including electrically insulative magnetizable particles and electrically insulative non-magnetizable particles. In the developing method, magnetic attractive force exerted on the magnetizable particles located at the developing position where a magnetic brush of the developing material formed on a developing material support member is in rubbing contact with electrostatic latent images on a recording medium, is made larger than the electric repelling force acting on the magnetizable particles for preventing the magnetizable particles from adhering to the recording medium.

3 Claims, 1 Drawing Figure

MAGNETIC BRUSH DEVELOPING METHOD FOR USE IN ELECTROGRAPHY EMPLOYING DUAL-COMPONENT DEVELOPING MATERIAL

BACKGROUND OF THE INVENTION

The present invention generally relates to a developing method for use in electrography and more particularly, to a magnetic brush developing method for use in electrography which utilizes a two or dual-component developing material including electrically insulative magnetizable particles as carrier and electrically insulative non-magnetizable particles as toner.

Recently, for a developing material to be used for magnetic brush development in electrography, electrically insulative magnetizable particles of small diameter ($5\sim30\mu$) prepared by dispersing fine magnetizable powder into a bonding agent or bonding material have come to be practically employed as carrier instead of the conventional iron particles, etc. of larger diameter ($80\sim200\mu$). In connection with the above, a developing material composed of electrically insulative magnetizable particles with average particle diameter of 5 to $30\mu$ prepared by dispersing magnetizable powder into electrically insulative resin having specific resistance higher than $10^{14}\Omega$.cm, and electrically insulative non-magnetizable particles (toner) with average particle diameter of 3 to $30\mu$ and volume resistivity higher than $10^{14}\Omega$.cm, has conventionally been put into actual use as disclosed, for example, in Japanese Laid Open Patent Application Tokkaisho 54-66134. The known dual-component developing material of the above described kind has advantages in that the quality of the copied images is superior, and moreover, the range of allowance for variations of mixing ratio of carrier to toner is large as compared with the conventional developing materials. On the other hand, however, in the conventional dual-component developing material of the above described type, there have been such problems that, since the electrically insulative magnetizable particles as carrier are very small in size, they tend to adhere to a photoreceptor surface during development. When the developing material remaining on the photoreceptor surface is removed by a blade cleaner or the like after transfer of developed images, the magnetizable particles are held between the photoreceptor surface and the blade. This results in various inconveniences such that the magnetizable powder contained in the magnetizable particles injures the photoreceptor surface or that, since the magnetizable particles are gradually consumed in a very small amount due to their adhesion to the photoreceptor surface, the amount of carrier tends to be decreased during continuous use for a long period of time unless such magnetizable particles are collected for re-use, consequently giving rise to insufficient development due to shortage of carrier.

SUMMARY OF THE INVENTION

Accordingly, an essential object of the present invention is to provide a magnetic brush developing method for use in electrography which employs an improved dual-component developing material capable of providing copied images superior in qualities such as resolving power, gradation, etc. without adhesion of electrically insulative magnetizable particles to a photoreceptor surface during development.

Another object of the present invention is to provide an improved dual-component developing material of the above described type which is stable in performance and simple in structure, and can be manufactured on a large scale at low cost.

In accomplishing these and other objects according to one preferred embodiment of the present invention, there is provided a magnetic brush developing method for use in electrography which comprises the steps of providing a dual-component developing material which includes electrically insulative magnetizable particles as carrier mainly composed of magnetizable powder and bonding material, and electrically insulative non-magnetizable particles as toner mainly composed of coloring material, dye and thermoplastic resin for bonding material; attracting the developing material onto a developing sleeve made of non-magnetizable material, by the action of a magnet member provided in the developing sleeve, to form a magnetic brush of the developing material on the developing sleeve; and bringing the magnetic brush into contact with an electrostatic latent image formed on a recording medium under the impression of a toner fogging prevention bias voltage so as to develop the electrostatic latent image into a visible image. The magnetic brush developing method further includes the step of causing silica to adhere onto the surfaces of the electrically insulative non-magnetizable particles to make the magnetic attractive force exerted by said magnet member on the electrically insulative magnetizable particles contacting the recording medium, larger than the electric repelling force acting on the magnetizable particles in the direction toward the recording medium, thereby to prevent adhesion of the electrically insulative magnetizable particles to the recording medium.

By the arrangement according to the present invention as described above, the magnetic brush developing method capable of providing copied images of high quality has been advantageously presented, with substantial elimination of disadvantages inherent in the conventional developing method of this kind.

BRIEF DESCRIPTION OF THE DRAWING

These and other objects and features of the present invention will become apparent from the following description taken in conjunction with the preferred embodiment thereof with reference to the accompanying FIGURE which is a fragmentary side elevational view of a developing portion of a magnetic brush developing apparatus to which the developing method according to the present invention may be applied.

DETAILED DESCRIPTION OF THE INVENTION

Figure 1:
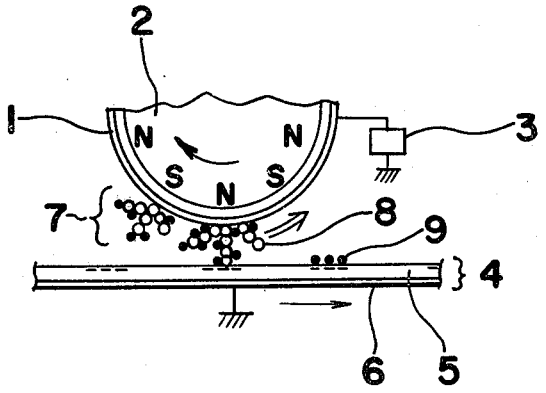

The dual-component developing material for use in electrography according to the present invention includes electrically insulative magnetizable particles mainly composed of magnetizable powder and bonding material, and electrically insulative non-magnetizable particles mainly composed of coloring material, dye and thermoplastic resin, and is characterized in that silica is caused to adhere to the surfaces of said non-magnetizable particles.

The magnetizable particles should normally contain $67\sim300$ weight parts, and more preferably, $150\sim300$ weight parts of the magnetizable powder to 100 weight parts of the bonding material, and should have an average particle diameter of $10\sim35\mu$ and more particularly, $15\sim30\mu$. On the other hand, the non-magnetizable particles should normally contain 2~20 weight parts each of the coloring material and dye to 100 weight parts of the thermoplastic resin, and 0.05~2 weight % of silica adhering to the surfaces thereof, and should have an average particle diameter of 5~25μ and more preferably, 9~18μ. Meanwhile, the mixing ratio of the magnetizable particles to the non-magnetizable particles should be 65:35 to 99:1 and more preferably, 80:20 to 97:3 by weight.

It is to be noted that, in the present specification, the electrically insulative magnetizable particles means those having a volume resistance higher than $10^{10}$ Ω.cm, while the electrically insulative non-magnetizable particles indicate those having a volume resistance higher than $10^{13}$Ω.cm.

The reasons for limiting the compositions of the developing material according to the present invention as described above are as follows.

Generally, in the magnetic brush developing method employing the dual-component developing material, the developing is effected in such a manner that the magnetizable particles as carrier and the non-magnetizable particles as toner, subjected to electrostatic attraction therebetween by triboelectric charging through mixing and stirring thereof, are caused to be attracted, in the form of brush bristles, onto the peripheral surface of a sleeve or outer cylinder of non-magnetizable material having a magnet member incorporated therein so as to be transported up to a developing position and rubbed against electrostatic latent images formed on the photoreceptor surface in a known manner. In connection with the above, as a result of investigations made by the present inventors into the causes for the adhesion of the magnetizable particles, charged to the polarity opposite that of the non-magnetizable particles, (therefore, to the same polarity as that of the photoreceptor surface), onto the photoreceptor surface, it has been found that the adhesion of the magnetizable particles depends on the charge amount and magnitude of the magnetization thereof. Also, in addition to the magnetic attraction by the magnet member within the developing sleeve, which attracts the magnetizable particles toward said sleeve during developing, the electric repelling force produced by the bias voltage normally applied to the developing sleeve for the prevention of fogging and directing the magnetizable particles toward the photoreceptor surface, acts on the magnetizable particles, and the undesirable adhesion of the magnetizable particles is liable to take place when the above electric repelling force is larger than the magnetic attraction or magnetic attractive force. Since the charge amount and magnitude of the magnetization of the magnetizable particles as described above depend not only on the components of the magnetizable particles alone, but also on the components of the non-magnetizable particles, they are so determined that the best results are obtained in the prevention of adhesion of the magnetizable particles onto the photoreceptor surface, and also in the quality of copied images.

For the magnetizable powder and bonding material which are the main components of the magnetizable particles, known materials normally used may be employed. For example, fine particles of magnetite, ferrite, pure iron, etc. having an average particle diameter of less than 3μ and more preferably, of less than 1.5μ may be favorably employed for the magnetizable powder. Meanwhile, for the bonding material, heat-hardening resins such as modified acrylic resin, phenolic resin, melamine resin, urea resin, etc. may be employed, besides thermoplastic resins such as polystyrene, polyethylene, polypropylene, vinyl group resin, polyacrylate, polymethacrylate, polyvinylidene chloride, polyacrylonitride, polyether, polycarbonate, thermoplastic polyester, cellulose group resins and monomer copolymer resins thereof, etc., because the magnetizable particles acting as carrier are not required to have fixing ability as in the toner. The mixing ratio of the bonding material to the magnetizable powder has a large influence on the magnitude of magnetization of the magnetizable particles and requires special attention, and should normally be 67~300 weight parts and more preferably, 150~300 weight parts of the magnetizable powder to 100 weight parts of the bonding material. The above ratio is determined based on the finding that, if the magnetizable powder is less than 67 weight parts, sufficient magnetic attraction can not be obtained, with consequent undesirable adhesion of the magnetizable particles and deterioration in the transporting nature thereof, while on the other hand, if it exceeds 300 weight parts, ample bonding ability may not be achieved due to excessively small amount of the bonding material, although the magnetic attraction is increased, thus making the particles undesirably fragile. The carbon to be added to the magnetizable particles, depending on necessity as charging control agent and resistant control agent, should preferably be suppressed to less than 15 weight parts in its ratio with respect to 100 weight parts of the bonding material for maintaining the volume resistance of the magnetizable particles higher than $10^{10}$Ω.cm. The average particle diameter of the magnetizable particles has been set in the above range, since it affects the image quality, charging amount and transporting nature thereof on the developing sleeve in such a manner that, if the average particle diameter thereof is less than 10μ, the magnetizable particles are liable to adhere to the photoreceptor surface due to deterioration in the transportability and increased charge amount, while, if it exceeds 35μ, copied images tend to have a rough grain, resulting in lowering of the image quality, although the magnitude of magnetization is increased.

The non-magnetizable particles, especially the components thereof, largely affect the adhesion of the magnetizable particles to the photoreceptor surface. The coloring material and dye are correlated to each other, and, if the amount of one is increased, the charge amount of the magnetizable particles may be suppressed even when the other is used in a small amount. However, the coloring material can not achieve the intended coloring purpose if it is less than 2 weight parts, and, upon exceeding 20 weight parts, the volume resistance becomes exceedingly low, resulting in reduction of image quality due to deterioration of transfer efficiency. For the coloring material, carbon black such as furnace black, acetylene black, etc. may normally be employed. The dye to be added for the purpose of charge control, besides coloring, is set to be in the range of 2~20 weight parts, since, if its amount is less than 2 weight parts, the charge amount of the magnetizable particles is increased so as to make it difficult to prevent the adhesion of the magnetizable particles to the photoreceptor surface, while on the other hand, if its amount exceeds 20 weight parts, transfer efficiency is deteriorated with simultaneous reduction of image quality due to excessive decrease of the charge amount of the non-magnetizable particles and magnetizable particles, although the adhesion of the magnetizable particles may be prevented. For the dye as described above, oil soluble dyes such as nigrosine group oil black, spirit black, nigrosine, etc., basic dyes such as crystal violet and metal complex dyes such as palatine dyes, orazol dyes, etc. are suitable.

Silica particularly useful for preventing the undesirable adhesion of the magnetizable particles is to be added in the range of 0.05~2 weight %, since if its amount is less than 0.05 weight %, the intended effect can not be achieved, while, if it exceeds 2 weight %, deterioration of image quality is brought about, although the adhesion of the magnetizable particles is prevented. For the silica as described above, commercially available hydrophobic silica may be employed.

For the thermoplastic resin to be used as the bonding material, those adopted as the bonding material for the magnetizable particles described earlier may also be employed.

The average particle diameter of the non-magnetizable particles is set to be in the range 5~25μ and more preferably 9~18μ, because if it is less than 5μ, fluidity is markedly reduced, while upon exceeding 25μ, the copied images have a rough grain, with consequent reduction in the quality of the copied images.

The magnetizable particles and non-magnetizable particles may be mixed at any weight ratio in the region from 65:35 to 99:1 and more preferably, from 80:20 to 97:3 on the assumption that the total amount is 100, but attention should be directed to the fact that, if the amount of the non-magnetizable particles is less than 1 weight %, the image density is insufficient, while if it exceeds 35 weight %, dust of the non-magnetizable particles tends to be generated.

In the main aspect, the present invention intends to provide an improved magnetic brush developing method for use in electrography utilizing developing material including the electrically insulative magnetizable particles and electrically insulative non-magnetizable particles. The developing method is characterized in that the magnetic attraction or attractive force acting on the magnetizable particles located at the developing position, where the magnetic brush bristles of the developing material formed on the developing material supporting member such as the developing sleeve are in rubbing contact with the electrostatic latent image carrying member such as the photoreceptor surface, is made larger than the electric repelling force acting on said magnetizable particles for efficient developing.

The development in which the magnetic attraction exerted on the magnetizable particles is made larger than the electric repelling force acting thereon may be achieved by employing the developing material of the present invention described earlier. However, for further improvements of the gradation and resolving power through elimination of irregularities, scratches, etc. in the copied images, it is preferable to incorporate such relationships that the distance d between the electrostatic latent image carrying member (i.e. the photoreceptor surface) and the developing material supporting member (e.g. the developing sleeve) is 0.5 mm$\leqq$d$\leqq$0.9 mm, the magnetic strength M of the magnet member in the developing material support member is 750 gauss$\leqq$M$\leqq$1300 gauss, and the bias voltage $V_B$ is higher than the residual potential of the photoreceptor surface by 50~100 V in absolute values. The distance d is set in the above relation, because, if it is less than 0.5 mm, line image in the area image becomes difficult to be observed due to insufficient edge effect, with consequent insufficient gradation, and moreover, irregular density may result in the case of totally black portions of copied images due to reduction through restriction of the transported amount of the developing material. If the distance d exceeds 0.9 mm, the density at the area image portions is reduced due to excessively high edge effect. Similarly, the magnetic strength M of the magnet member is set to be in the above range, because if it is less than 750 gauss, unevenness in the copied images may take place due to unsmooth transportation of the developing material, while if the magnetic strength M exceeds 1300 gauss, the magnetic brush bristles become excessively hard and form scratches or the like in the copied images, and moreover, give rise to increase heat generation through movement of the magnet member, increase of driving force required, etc.

Although the developing bias voltage $V_B$ may differ according to the photoreceptor employed, in the case where a photoreceptor prepared by a mixture of cadmium sulfide group photoconductive material and resin is employed, the bias voltage $V_B$ should preferably be in the range of −200 V~−450 V, since the residual potential is about −100 V at the maximum when the photoreceptor of the above described kind is used at negative charge. If the bias voltage $V_B$ is higher than −200 V, sufficient effect can not be obtained by the bias voltage application, while if it is lower than −450 V, the undesirable adhesion of the magnetizable particles to the photoreceptor surface begins to take place even when the developing material according to the present invention is employed.

The developing method according to the present invention will be described more specifically hereinbelow with reference to FIG. 1 schematically showing a developing portion for use in the magnetic brush developing method.

The arrangement of FIG. 1 generally includes the developing material support member or developing sleeve 1, the magnetic field generating means or magnet roll member 2 rotatably housed in said developing sleeve 1 for rotation in the direction indicated by the arrow, and the electrostatic latent image bearing member or photoreceptor 4 movably disposed below and adjacent to the developing sleeve 1 for movement in the direction of the arrow. The photoreceptor 4 further includes a photosensitive layer 5 which is provided on a conductive base 6 and on which the electrostatic latent image is formed in a known manner. In the above arrangement, the electrostatic latent image is of negative polarity, and the electrically insulative magnetizable particles 8 and electrically insulative non-magnetizable particles 9 in the magnetizable developing material 7 are so selected as to be charged to the positive polarity for the non-magnetizable particles and to the negative polarity for the magnetizable particles through friction therebetween. In the magnetizable developing material 7, the magnetizable particles function as the so-called carrier, and carry the non-magnetizable particles adhering thereto through electrostatic force up to the developing position so as to supply the non-magnetizable particles charged to the positive polarity to the electrostatic latent image of negative polarity for adhesion to the latter and consequent development. For the prevention of fogging, etc., bias voltage may be applied to the developing sleeve 1 as shown at 3 in FIG. 1.

In the arrangement as described above, the developing conditions are set as described earlier so as to make the magnetic attraction acting on the magnetizable particles 8 located at the developing position where the magnetic brush formed on the developing sleeve 1 is in rubbing contact with the photoreceptor surface 5, larger than the electric repelling force exerted on said magnetizable particles, and the development is effected by the use of the above developing material of the present invention.

It should be noted here that for the photoconductive materials constituting the photoreceptor, those conventionally used may be employed besides cadmium sulfide group photoconductive materials which are composed of cadmium sulfide or cadmium sulfide and cadmium carbonate and represented by the general formula $CdS.nCdCO_3(0 \leqq n \leqq 4)$ or composed of such substances and further doped with metallic active agents, for example, copper, silver, etc. as acceptor impurities. The configuration of the photoreceptor is not limited to the drum shape, but may be modified to any other shapes such as film-like or belt-like configuration depending on necessity.

Hereinbelow, EXAMPLES are inserted for the purpose of illustrating the present invention, without any intention of limiting the scope thereof.

EXAMPLE 1

| | |
|---|---|
| HYMER-SBM 73 (name used in trade for styrene.acryl copolymer manufactured by Sanyo Chemical Industries, Ltd. Japan) | 100 weight parts |
| RB-BL (name used in trade for tri-iron tetroxide manufactured by Chitan Kogyo Co., Ltd., Japan) | 200 weight parts |
| MA #100 (name used in trade for carbon black manufactured by Mitsubishi Kasei Co., Ltd., Japan) | 4 weight parts |

The mixture of the above compositions was sufficiently kneaded by a known three-roll mill, and after cooling and subsequent crushing by an ordinary method, classified to obtain insulative magnetizable particles having an average particle diameter of 21μ.

100 weight parts of styreneacryl copolymer resin PICCOLASTIC D-125 (name used in trade and manufactured by Esso Standard Co., U.S.A.), 8 weight parts of carbon black MA #100 (mentioned earlier), and 2 weight parts of oil black BS (name used in trade and manufactured by Orient Chemical Co., Ltd., Japan) were sufficiently kneaded by a known three-roll mill, and after cooling and subsequent crushing by an ordinary method, classified to obtain fine particles having an average particle diameter of 14μ, to which hydrophobic silica R-972 (name used in trade and manufactured by Nippon Aerosil Co., Ltd., Japan) was added at the rate shown in Table 1, with sufficient mixing and stirring and thus, electrically insulative non-magnetizable particles having silica adhering on the surfaces thereof were obtained.

The magnetizable particles and non-magnetizable particles thus obtained were mixed at the weight ratio of 90:10 to prepare the dual-component developing material. By employing this developing material, experimental copying was carried out with the use of a magnetic brush developing apparatus equipped with a stirring device for investigating the state of adhesion of the magnetizable particles onto the surface of the photoreceptor and also the image quality, the results of which are shown in Table 2 together with the charge amounts of the magnetizable particles. In the above experiment, the developing conditions were as follows.

| | |
|---|---|
| System speed (moving speed of the photoreceptor) | 11 cm/sec. |
| Developing bias potential | −300 V |
| Distance d between the photoreceptor and developing sleeve | 0.7 mm |
| Magnetic strength of the magnet roll member | 1000 gauss |
| Surface potential of the photoreceptor | |
| Image formed portion | −550 V |
| Non-image formed portion | −200 ~ −250 V |

Photoreceptor: Cadmium sulfide photoconductive material-resin mixed group photoreceptor

TABLE 1

| Sample No. | Compositions of non-magnetizable particles: Styrene resin (wt part) | Carbon black (wt part) | Oil black (wt part) | Silica (wt %) |
|---|---|---|---|---|
| 1 | 100 | 8 | 2 | 0 |
| 2 | 100 | 8 | 2 | 0.1 |
| 3 | 100 | 8 | 2 | 0.2 |
| 4 | 100 | 8 | 2 | 0.5 |
| 5 | 100 | 8 | 2 | 1.0 |

TABLE 2

| Sample No. | Magnetizable particle charge amount (μc/gr) | Adhesion of magnetizable particles | Image quality |
|---|---|---|---|
| 1 | −1.5 | Noticed | Favorable |
| 2 | −1.3 | Not noticed | Favorable |
| 3 | −1.2 | Not noticed | Favorable |
| 4 | −1.0 | Not noticed | Favorable |
| 5 | −0.8 | Not noticed | Favorable |

As is clear from the results of Table 2, under predetermined developing conditions, the adhesion of the magnetizable particles to the photoreceptor surface takes place when the charge amount of the magnetizable particles exceeds a certain value, but in the developing method and the developing material employed therefore according to the present invention, the undesirable adhesion of the magnetizable particles was not noticed at all, with copied images of high quality being simultaneously obtained.

Moreover, in EXAMPLE 1, by altering the magnetic strength of the magnet roll member to 1300 gauss, studies were made on the state of adhesion of the magnetizable particles and image quality, with reference to silica addition amounts of 0, 0.05, 0.1 and 0.2 weight %, the results of which are shown in Table 3 below.

TABLE 3

| Silica addition amount (wt %) | 0 | 0.05 | 0.1 | 0.2 |
|---|---|---|---|---|
| Adhesion of magnetizable particles | Noticed | Not noticed | Not noticed | Not noticed |
| Image quality | Good | Good | Good | Good |

Furthermore, in EXAMPLE 1, the distance d between the photoreceptor surface and developing sleeve was altered to 0.5 mm, and similar studies were made on the adhesion of the magnetizable particles onto the photoreceptor surface, with reference to silica addition amounts of 0, 0.05, and 0.1 weight %, with the findings as shown in Table 4 below.

TABLE 4

| Silica addition amount (wt %) | 0 | 0.05 | 0.1 |
|---|---|---|---|
| Adhesion of magnetizable particles | Noticed | Not noticed | Not noticed |
| Image quality | Good | Good | Good |

EXAMPLE 2

With employment of 100 weight parts of styreneacryl copolymer resin, PLIOLITE ACL (name used in trade and manufactured by Goodyear Company Ltd., U.S.A.), and 200 weight parts of tri-iron tetroxide, BL-500 (name used in trade and manufactured by Chitan Kogyo Co., Ltd., Japan), electrically insulative magnetizable particles (volume resistance $10^{14}\Omega$.cm), with average particle diameter of 16μ were obtained in a manner similar to EXAMPLE 1.

Apart from the above, by employing 100 weight parts of styrene resin, PICCOLASTIC E-125 (name used in trade and manufactured by Esso Standard Co., U.S.A.), 2 weight parts of oil black, nigrosine base EX (name used in trade and manufactured by Orient Chemical Co., Ltd., Japan), and 8 weight parts of carbon black KETCHEN BLACK EC (name used in trade and manufactured by the Lion Yushi Co., Ltd., Japan), fine particles having an average particle diameter of 14μ were obtained in a manner similar to EXAMPLE 1, and by adding thereto, 1.5 weight % of silica, non-magnetizable particles (volume resistance $10^{15}\Omega$.cm) containing silica adhering to the surfaces thereof were prepared.

The magnetizable particles and non-magnetizable particles thus obtained were mixed at the weight ratio of 80:20 to prepare the dual-component developing material. By using this dual-component developing material, experimental copying was carried out in a manner similar to EXAMPLE 1, as a result of which no adhesion of the magnetizable particles to the photoreceptor surface was noticed, with copied image of superior quality being obtained.

EXAMPLE 3

By employing 100 weight parts of styrene-acryl copolymer resin and 200 weight parts of tri-iron tetroxide, insulative magnetizable particles having average particle diameter of 30μ were obtained in a manner similar to EXAMPLE 1.

On the other hand, with employment of 100 weight parts of styrene resin, PICCOLASTIC E-125 (described earlier), 2 weight parts of oil black, nigrosine base EX (described earlier), and 2 weight parts of carbon black KETCHEN BLACK EC (described earlier), fine particles were obtained in a manner similar to EXAMPLE 1, and by adding thereto, 0.1 weight % of silica, non-magnetizable particles having an average particle diameter of 10μ were prepared.

The magnetizable particles and non-magnetizable particles thus obtained were mixed at the weight ratio of 90:10 to prepare the dual-component developing material. By using this dual-component developing material, experimental copying was carried out in a manner similar to EXAMPLE 1, as a result of which no adhesion of the magnetizable particles to the photoreceptor surface was noticed, and copied images of superior quality were obtained.

Additionally, as a result of a further experimental copying carried out by altering the silica addition amount in EXAMPLE 3 to 2.0 weight %, no adhesion of the magnetizable particles to the photoreceptor surface was noticed, and the image quality was also comparatively good.

Although the present invention has been fully described by way of examples with reference to the accompanying drawing, it is to be noted that various changes and modifications will be apparent to those skilled in the art. Therefore, unless otherwise such changes and modifications depart from the scope of the present invention, they should be construed as included therein.

What is claimed is:

1. A magnetic brush developing method for use in electrography which comprises the steps of providing a dual-component developing material which includes electrically insulative magnetizable particles as carrier mainly composed of magnetizable powder and bonding material, and electrically insulative non-magnetizable particles as toner mainly composed of coloring material, dye and thermoplastic resin for bonding material; attracting said developing material onto a developing sleeve made of non-magnetizable material, by the action of a magnet member provided in said developing sleeve, to form a magnetic brush of said developing material on said developing sleeve; and bringing said magnetic brush into contact with an electrostatic latent image formed on a recording medium under the impression of a toner fogging prevention bias voltage so as to develop said electrostatic latent image into a visible image; said magnetic brush developing method further including the step of causing silica to adhere onto the surfaces of said electrically insulative non-magnetizable particles to reduce the triboelectric charge on said magnetizable particles to make the magnetic attractive force exerted by said magnet member on said electrically insulative magnetizable particles contacting said recording medium larger than the electric repelling force acting on said magnetizable particles in the direction toward said recording medium, thereby to prevent adhesion of said electrically insulative magnetizable particles to said recording medium.

2. A magnetic brush developing method as claimed in claim 1, wherein said electrically insulative magnetizable particles have a volume resistance higher than $10^{10}\Omega$.cm and an average particle diameter of 10 to 35μ, said bias voltage is higher than the residual potential at the non-image portion on said recording medium by 50 to 100 V in absolute value, said electrically insulative non-magnetizable particles contain said silica in an amount of 0.05 to 2 weight % adhering onto the surfaces thereof with respect to 100 weight parts of said thermoplastic resin, the distance between said recording medium and said developing sleeve is 0.5 to 0.9 mm, and the magnetic strength of said magnet member is 750 to 1300 gauss.

3. A magnetic brush developing method as claimed in claim 1 or 2, wherein said magnetizable particles contain 67–300 weight parts of said magnetizable powder to 100 weight parts of said bonding material, said non-magnetizable particles contain 2–20 weight parts of each of said coloring material and said dye to 100 weight parts of said thermoplastic resin, said non-magnetizable particles have an average particle diameter of 5–25μ and a volume resistance higher than $10^{13}\Omega$.cm, and the weight ratio of said magnetizable particles to said non-magnetizable particles is within the range from 65:35 to 99:1.

* * * * *